US011629394B2

(12) United States Patent
Chen et al.

(10) Patent No.: US 11,629,394 B2
(45) Date of Patent: Apr. 18, 2023

(54) METHOD FOR PREPARING GRADIENT HARDENED TITANIUM ALLOY

(71) Applicant: BEIJING INSTITUTE OF TECHNOLOGY, Beijing (CN)

(72) Inventors: Pengwan Chen, Beijing (CN); Yansong Guo, Beijing (CN); Qiang Zhou, Beijing (CN); Rui Liu, Beijing (CN)

(73) Assignee: BEIJING INSTITUTE OF TECHNOLOGY, Beijing (CN)

( * ) Notice: Subject to any disclaimer, the term of this patent is extended or adjusted under 35 U.S.C. 154(b) by 0 days.

(21) Appl. No.: 17/880,652

(22) Filed: Aug. 4, 2022

(65) Prior Publication Data

US 2023/0068869 A1 Mar. 2, 2023

(30) Foreign Application Priority Data

Aug. 27, 2021 (CN) ..... 202110998042.9

(51) Int. Cl.
*C22F 3/00* (2006.01)
*C22C 14/00* (2006.01)

(52) U.S. Cl.
CPC ..... *C22F 3/00* (2013.01); *C22C 14/00* (2013.01)

(58) Field of Classification Search
CPC ..... C22F 3/00; C22C 14/00
USPC ..... 148/515
See application file for complete search history.

(56) References Cited

U.S. PATENT DOCUMENTS 3,608,490 A * 9/1971 O'Keefe ..... B23K 20/08 102/305
3,615,921 A * 10/1971 Delgrosso ..... C21D 10/00 148/578
2009/0142586 A1* 6/2009 Otsuka ..... C22C 14/00 428/323

(Continued)

FOREIGN PATENT DOCUMENTS

KR 20190107917 A * 9/2019 ..... C21D 1/18

OTHER PUBLICATIONS

Jaw et al.; "Thermal Behaviors of PETN Base Polymer Bonded Explosives"; Journal of Thermal Analysis and Calorimetry, vol. 93, 2008, pp. 953-957 (Year: 2008).*

(Continued)

*Primary Examiner* — Keith Walker
*Assistant Examiner* — Adil A. Siddiqui
(74) *Attorney, Agent, or Firm* — Zhigang Ma

(57) ABSTRACT

In a method for preparing a gradient hardened titanium alloy. A steel momentum block and a cleaned titanium alloy plate are sequentially placed into a steel base with a through hole from bottom to top, a cross sectional size of the through hole is matched with cross sectional sizes of the steel momentum block and the titanium alloy plate, and a height of the through hole is matched with a total thickness of the steel momentum block and the titanium alloy plate. An explosive frame is fixed on a top edge of the steel base, a high explosion velocity explosive with an explosion velocity of 7000 m/s or more pressed into a plate-shaped structure is placed in the explosive frame, and detonation is caused at one end of a top surface of the explosive to perform impact treatment on the titanium alloy plate, thereby obtaining the gradient hardened titanium alloy.

11 Claims, 3 Drawing Sheets

(56) References Cited

U.S. PATENT DOCUMENTS

2016/0186536 A1* 6/2016 Dai ..... F42B 3/08
102/306

OTHER PUBLICATIONS

Wikipedia; "Table of explosive detonation velocities", https://web.archive.org/web/20200229042716/https://en.wikipedia.org/wiki/Table_of_explosive_detonation_velocities, webpage snapshot from Feb. 2020 (Year: 2020).*
KR20190107917A: Espacenet English machine translation (Year: 2019).*
CNIPA, Notification of a First Office Action for CN202110998042.9, dated Dec. 1, 2021.
Beijing Institute of Technology (Applicant), Reply to Notification of a First Office Action for CN202110998042.9, w/allowed replacement claims, dated Dec. 6, 2021.
CNIPA, Notification to grant patent right for invention in CN202110998042.9, dated Jan. 17, 2022.

* cited by examiner

METHOD FOR PREPARING GRADIENT HARDENED TITANIUM ALLOY

TECHNICAL FIELD

The invention relates to the field of gradient hardened materials, in particularly to a method for preparing a gradient hardened titanium alloy.

BACKGROUND

A gradient material is a heterogeneous composite material whose structure and properties vary continuously or quasi-continuously in its thickness-wise or lengthwise direction of the material. Gradient materials are widely used in various fields such as aerospace, machinery, electromagnetism, biology, nuclear energy and electrical engineering, for example are applied in various equipment such as in aerospace engines, bearings in mechanical engineering, magnetic disks and oscillators in electromagnetic engineering, teeth, bones and joints in biological engineering, and thermoelectric converters in nuclear and electrical engineering. Titanium alloys are one kind of materials with highest specific strength in the materials currently used. The titanium alloys have characteristics of high specific strength, good corrosion resistance and good heat resistance, and are widely used in aviation, aerospace, petroleum, chemical industry, shipbuilding and other fields. However, due to low hardness, high friction coefficient and poor wear resistance, service life and application scope of the titanium alloy are affected to a certain extent. It is an effective way to improve the surface wear resistance and service life of the titanium alloy by using appropriate surface hardening technology to improve surface hardness of the titanium alloy without reducing mechanical properties of a matrix, which can expand the application scope of high-strength titanium alloys.

At present, a method for preparing a gradient hardened titanium alloy is usually to prepare a composite film structure with hardness gradient change on a surface of a titanium alloy, and the method is complicated in process, high in equipment cost, unstable in process, low in utilization rate, and high in rejection rate, so that the development of the gradient-hardened titanium alloy is limited.

SUMMARY

Accordingly, an objective of the invention is to provide a method for preparing a gradient hardened titanium alloy.

In order to achieve the above objective, the invention proposes technical solutions as follows.

Specifically, a method for preparing a gradient hardened titanium alloy, may include the following steps of:

putting a steel momentum block and a cleaned titanium alloy plate in a steel base with a through hole sequentially from bottom to top, wherein a size of a cross section of the through hole is matched with sizes of cross sections of the steel momentum block and the titanium alloy plate, and a height of the through hole is matched with a total thickness of the steel momentum block and the titanium alloy plate;

fixing an explosive frame on an edge of a top surface of the steel base;

placing high explosion velocity explosive with an explosion velocity of equal to or greater than 7000 m/s and pressed into a plate-shaped structure in the explosive frame; and detonating from an end of a top surface of the explosive to perform impact treatment on the titanium alloy plate to thereby obtain the gradient hardened titanium alloy.

In a preferred embodiment, the impact treatment is performed with twice or three times.

In a preferred embodiment, a ratio of a thickness of the titanium alloy plate:a thickness of the steel momentum block:a thickness of the high explosion velocity explosive:a horizontal distance between a side of the steel base close to an explosive detonation position and the titanium alloy plate:a distance between a side of the steel base far away from the explosive detonation position and the titanium alloy plate is 10-50:5-10:3-5:50-80:10-20.

In a preferred embodiment, a top surface and a bottom surface of the titanium alloy plate both are coated with grease, the top surface is a detonation surface, and the bottom surface is a contact surface of the titanium alloy plate with the steel momentum block. More preferably, a coating thickness of the grease is in a range of 0.5 mm to 1 mm. The bottom surface of the titanium alloy plate is coated with the grease to prevent an air gap between the titanium alloy plate and the steel momentum block from affecting a pressure relief effect of the steel momentum block; and the top surface of the titanium alloy plate is coated with the grease to prevent detonation energy after the explosive is detonated from burning the surface of titanium alloy plate.

In a preferred embodiment, a material of each of the steel base and the steel momentum block is 45# steel or stainless steel.

In a preferred embodiment, a material of the explosive frame is an organic glass.

In a preferred embodiment, the high explosion velocity explosive is castable powder explosive, plastic plate-shaped explosive or rubber plate-shaped explosive. More preferably, the high explosion velocity explosive is composition 4 (C4) explosive.

In a preferred embodiment, the explosive is fixed with the steel base together before the explosive is detonated.

The invention may achieve the following beneficial effects.

The invention provides a titanium alloy hardening treatment method which is different from the concept of the prior art. In the method, the titanium alloy is placed in a steel base with a specific structure, so that material damage caused by "boundary effect" in the process of impact treatment of high explosion velocity explosive can be effectively avoided. Through the impact treatment with a specific explosion velocity on the titanium alloy, a phase transformation from $\alpha$ to $\omega$ occurs in the hardening process of the titanium alloy, and thereby the gradient hardening of the top surface of the titanium alloy is realized.

Furthermore, the invention can further improve the phase change content of $\omega$ by carrying out 2-3 times of impact treatment on the titanium alloy, thereby improving the hardness of the titanium alloy.

In addition, by controlling the sizes of the titanium alloy, the steel momentum block and the steel base, the gradient-hardened titanium alloy may have better sample integrity and hardening uniformity.

The method of the invention may have advantages of low cost, good process stability, good controllability, high preparation efficiency and low rejection rate, and have important theoretical significance and practical value for the development and application of gradient hardened materials.

BRIEF DESCRIPTION OF DRAWINGS

In order to explain technical solutions of the invention more clearly, drawings used in embodiments of the invention will be briefly introduced below. Apparently, the drawings described below are only some embodiments of the invention. For those skilled in the art, other drawings can be obtained according to these illustrated drawings without creative work.

DETAILED DESCRIPTION OF EMBODIMENTS

The invention will be described below in further detail in combination with concrete embodiments.

Figure 1:
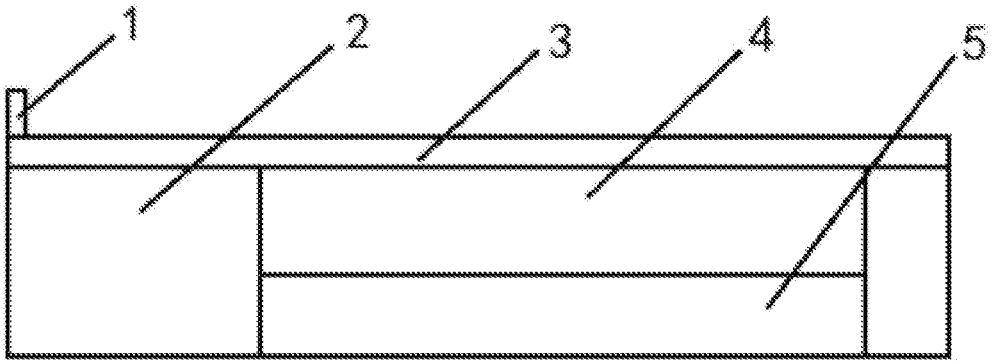
FIG. 1 illustrates a schematic structural front view of a device used for explosive impact treatment according to an embodiment of the invention, wherein the description of reference numerals is that: 1—detonator, 2—steel base, 3—explosive frame, 4—titanium alloy, and 5—steel momentum block.

In the following embodiments:

(1) a structure of a device used for explosive impact treatment is illustrated in FIG. 1. Specifically, a steel base 2 is a cuboid structure, a through hole is defined on the steel base 2, a steel momentum block 5 is placed at a bottom of the through hole, a titanium alloy 4 is placed on the steel momentum block 5, an explosive frame 3 is placed on a top surface of the steel base 2, a pressed high explosion velocity explosive is placed in the explosive frame 3, a detonator 1 is inserted into one end of a top surface of the high explosion velocity explosive and fixed by an adhesive tape, and the detonator 1 is connected with an initiator. A size of a cross section of the through hole of the steel base 2 is matched with sizes of cross sections of the steel momentum block 5 and the titanium alloy 4, and a height of the through hole is matched with a total thickness of the steel momentum block 5 and the titanium alloy 4 (i.e., a sum of thicknesses of the steel momentum block 5 and the titanium alloy 4).

A material of the steel base 2 is 45# steel, and a size of the through hole is 200 mm×150 mm×15 mm. A horizontal distance between a side of the steel base 2 close to an explosive detonation position and the titanium alloy 4 is 80 mm, and a horizontal distance between a side of the steel base 2 far away from the explosive detonation position and the titanium alloy 4 is 20 mm.

The titanium alloy 4 employs a TA2 titanium alloy plate with a size of 200 mm×150 mm×10 mm.

A material of the steel momentum block 5 is 45# steel, and a size thereof is 200 mm×150 mm×5 mm.

(2) the high explosion velocity explosive employs the C4 (abbreviation for Composition 4) explosive.

(3) hardness test: a micro Vickers hardness tester with a model of FM-700 is used, and test conditions are: a pressure of 2.4 newtons (N), and a pressure holding time of 15 seconds (s).

Embodiment 1

A method for preparing a gradient hardened titanium alloy may include steps as follows.

Step 1, polishing a surface of a titanium alloy by using a handheld electric grinding wheel to remove an oxide layer and cleaning the surface by using absolute ethyl alcohol to remove grease, to thereby obtain a cleaned titanium alloy.

Step 2, placing the steel base on a pre-paved sandpile, putting the steel momentum block and the titanium alloy into the through hole of the steel base sequentially from bottom to top, ensuring that a bottom surface of the steel base is flush with a bottom surface of the momentum block, and applying a layer of grease with a thickness of 0.5 mm on a contact interface between the steel base and the momentum block.

Step 3, evenly applying a layer of grease with a thickness of 0.5 mm on a detonation surface of the titanium alloy, and then fixing the explosive frame on an edge of the top surface of the steel base.

Step 4, putting the C4 explosive pressed into plate-shape in the explosive frame, wherein a thickness of the explosive is 5 mm, and an explosion velocity of the explosive is 7746 minute per second (m/s)/

Step 5, inserting the detonator into one end of the top surface of the explosive, fixing the detonator on the explosive by using an adhesive tape, and packing and compacting the explosive and the steel base.

Step 6, connecting the detonator with the initiator, and detonating to perform impact treatment on the titanium alloy to thereby obtain the gradient hardened titanium alloy.

Figure 2:
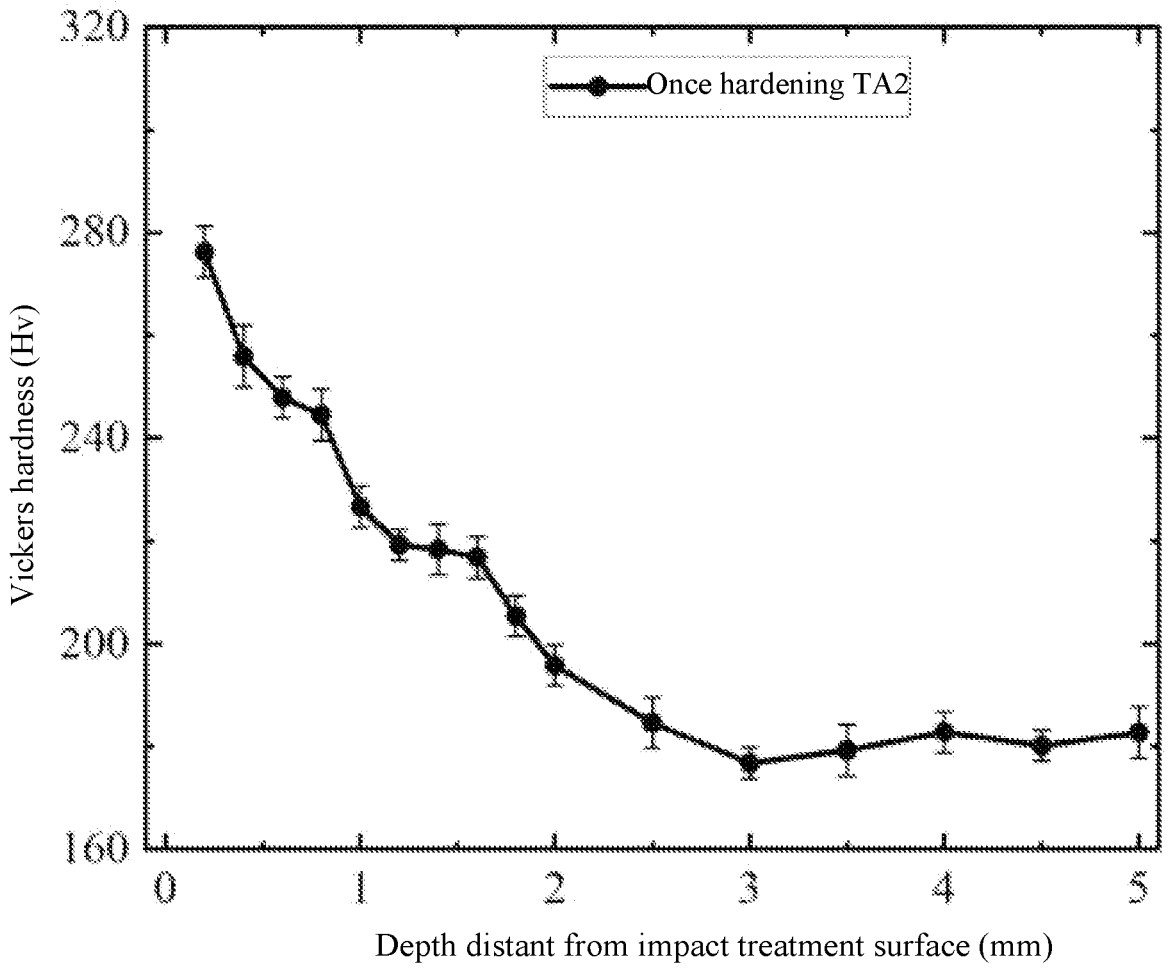
FIG. 2 illustrates a Vickers hardness distribution of a gradient hardened titanium alloy in embodiment 1 of the invention.

A Vickers hardness distribution of the obtained gradient-hardened titanium alloy is shown in FIG. 2, the hardness of the gradient-hardened titanium alloy is distributed in a gradient manner from the top surface along the thickness-wise direction, and the maximum hardness of the titanium alloy after one time of hardening is 280 Hv. Compared with an initial hardness of the titanium alloy, the maximum hardness of the titanium alloy after the one time of hardening is increased by 54.3%, and a hardened depth is 2.5 mm.

Figure 4:
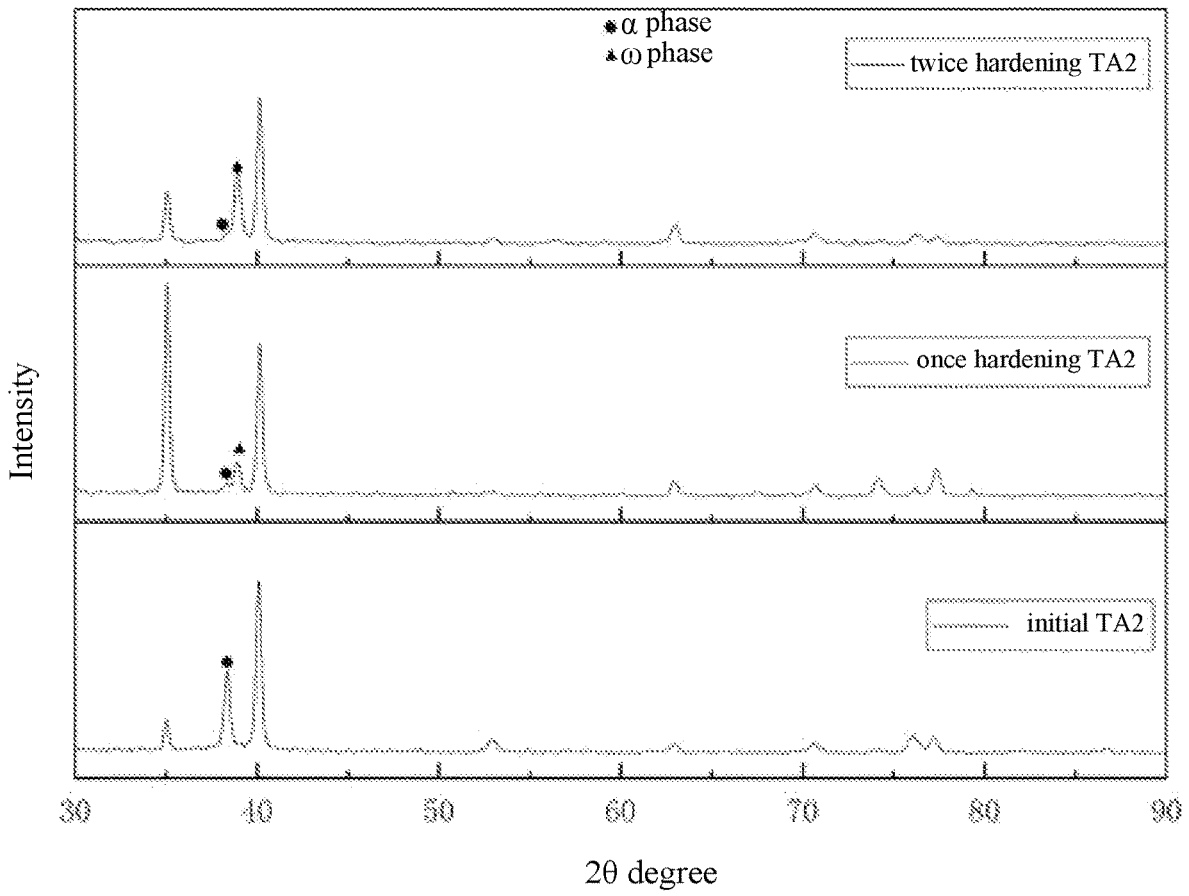
FIG. 4 illustrates a schematic X-ray diffraction (XRD) diagram of the gradient hardened titanium alloys in the embodiment 1 and the embodiment 2 of the invention.

An X-ray diffraction (XRD) test of the gradient hardened titanium alloy is shown in FIG. 4. The result shows that a phase transformation from alpha (α) to Omega (ω) occurs during the hardening process of the titanium alloy, and the occurrence of the phase transformation leads to the increase of the hardness of the titanium alloy.

Embodiment 2

In this embodiment, the impact treatment is performed twice, and the rest are the same as in the embodiment 1.

Figure 3:
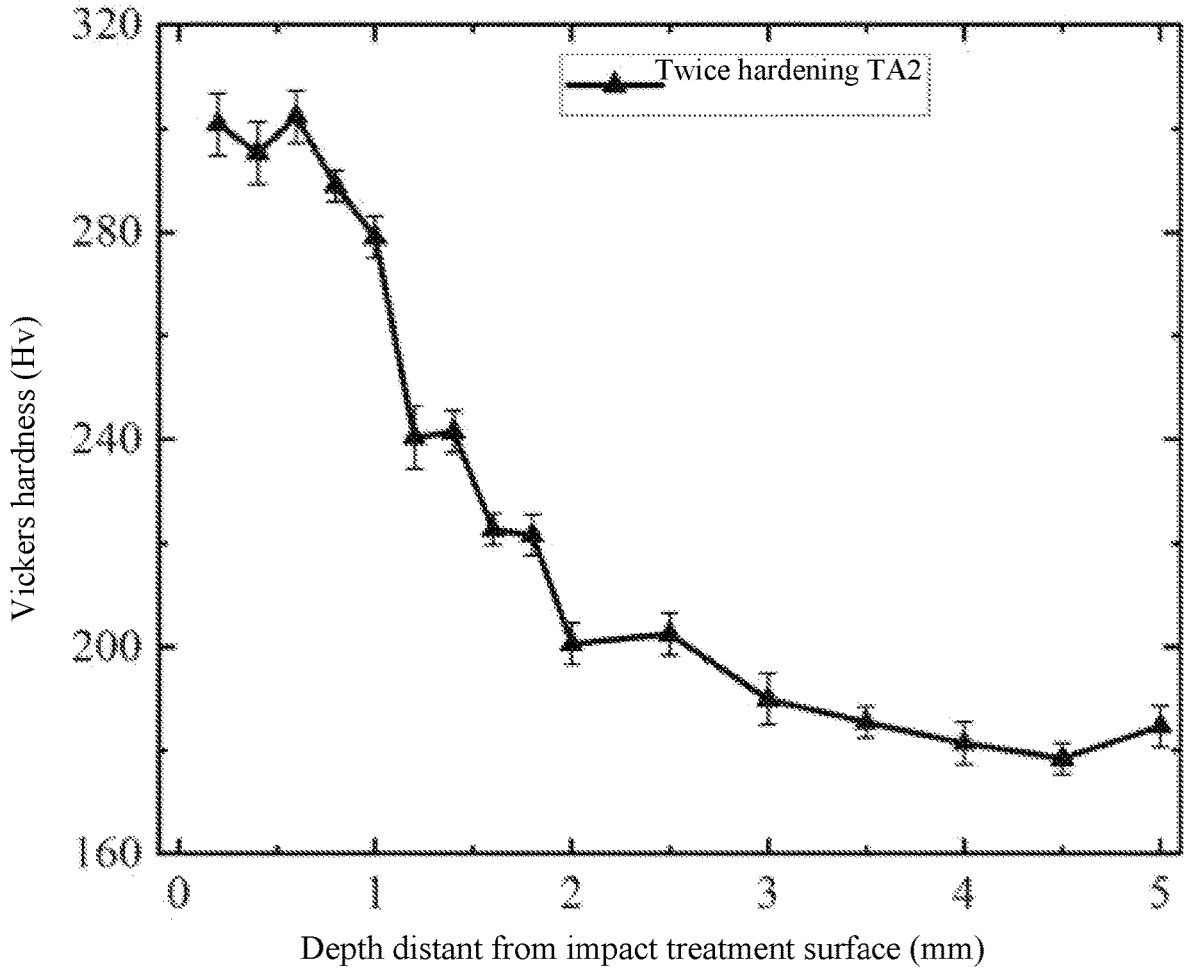
FIG. 3 illustrates a Vickers hardness distribution of a gradient hardened titanium alloy in embodiment 2 of the invention.

A Vickers hardness distribution of the obtained gradient hardened titanium alloy is shown in FIG. 3, the maximum hardness after twice hardening is increased to 300 Hv. In a depth range of 0-1 mm, the maximum hardness of the titanium alloy after the twice hardening is increased by 71% compared with an initial hardness of the titanium alloy, and the twice hardened depth is about 3.5 mm.

An XRD test of the gradient hardened titanium alloy is shown in FIG. 4. The result shows that a phase transformation from α to ω occurs during the hardening process of the titanium alloy, and a phase transformation content of ω is higher after the twice hardening, which further increases the hardness of the titanium alloy.

Embodiment 3

A method for preparing a gradient hardened titanium alloy may include steps as follows.

Step 1, polishing a surface of a titanium alloy by using a handheld electric grinding wheel to remove an oxide layer and cleaning the surface by using absolute ethyl alcohol to remove grease, to thereby obtain a cleaned titanium alloy.

Step 2, placing the steel base on a pre-paved sandpile, putting the steel momentum block and the titanium alloy into the through hole of the steel base sequentially from bottom to top, ensuring that a bottom surface of the steel base is flush with a bottom surface of the momentum block, and applying a layer of grease with a thickness of 0.5 mm on a contact interface between the steel base and the momentum block.

Step 3, evenly applying a layer of grease with a thickness of 0.5 mm on a detonation surface of the titanium alloy, and then fixing the explosive frame on an edge of the top surface of the steel base.

Step 4, putting the C4 explosive pressed into plate shape in the explosive frame, wherein a thickness of the explosive is 3 mm, and an explosion velocity of the explosive is 7746 minute per second (m/s)/

Step 5, inserting the detonator into one end of the top surface of the explosive, fixing the detonator on the explosive by using an adhesive tape, and packing and compacting the explosive and the steel base.

Step 6, connecting the detonator with the initiator and detonating to perform impact treatment on the titanium alloy, to thereby obtain the gradient hardened titanium alloy.

A result of a Vickers hardness distribution of the obtained gradient-hardened titanium alloy shows that the hardness of the gradient-hardened titanium alloy is distributed in a gradient manner from the top surface in the thickness-wise direction.

A XRD test result of the gradient hardened titanium alloy shows that the phase transformation from α to ω occurs during the hardening process of the titanium alloy.

Embodiment 4

In this embodiment, the explosion velocity of the explosive is 7300 m/s, and the rest are the same as in the embodiment 3.

A result of a Vickers hardness distribution of the obtained gradient-hardened titanium alloy shows that the hardness of the gradient-hardened titanium alloy is distributed in a gradient manner from the top surface in the thickness-wise direction.

A XRD test result of the gradient hardened titanium alloy shows that the phase transformation from α to ω occurs during the hardening process of the titanium alloy.

Embodiment 5

In this embodiment, the explosion velocity of the explosive is 7000 m/s, and the rest are the same as in the embodiment 3.

A result of a Vickers hardness distribution of the obtained gradient-hardened titanium alloy shows that the hardness of the gradient-hardened titanium alloy is distributed in a gradient manner from the top surface in the thickness-wise direction.

A XRD test result of the gradient hardened titanium alloy shows that the phase transformation from α to ω occurs during the hardening process of the titanium alloy.

In summary, the invention includes but is not limited to the above embodiments, and any equivalent substitution or partial improvement under the spirit and principle of the invention shall be deemed to be within the scope of protection of the invention.

What is claimed is:

1. A method for preparing a gradient hardened titanium alloy, comprising:

placing a steel base on a pre-paved sandpile; wherein the steel base is provided with a through hole;

putting a steel momentum block and a cleaned titanium alloy plate into the through hole sequentially from bottom to top, thereby making the steel momentum block be located on a bottom of the through hole and a bottom surface of the steel momentum block be flush with a bottom surface of the steel base, and making the cleaned titanium alloy plate be located on a top surface opposite to the bottom surface of the steel momentum block; wherein a size of a cross section of the through hole is matched with sizes of cross sections of the steel momentum block and the titanium alloy plate, and a height of the through hole is matched with a total thickness of the steel momentum block and the titanium alloy plate;

fixing an explosive frame on an edge of a top surface of the steel base; wherein the explosive frame is in contact with the cleaned titanium alloy plate, and the cleaned titanium alloy plate is located between the explosive frame and the steel momentum block;

placing high explosion velocity explosive with an explosion velocity of equal to or greater than 7000 m/s and pressed into a plate-shaped structure in the explosive frame; and detonating from an end of a top surface of the explosive to perform impact treatment on the titanium alloy plate to thereby obtain the gradient hardened titanium alloy;

wherein a ratio of a thickness of the titanium alloy plate: a thickness of the steel momentum block: a thickness of the high explosion velocity explosive: a horizontal distance between a side of the steel base close to an explosive detonation position and the titanium alloy plate: a distance between a side of the steel base far away from the explosive detonation position and the titanium alloy plate is 10-50:5-10:3-5:50-80:10-20.

2. The method for preparing the gradient hardened titanium alloy as claimed in claim 1, wherein the impact treatment is performed twice or three times.

3. The method for preparing the gradient hardened titanium alloy as claimed in claim 1, wherein a detonation surface of the titanium alloy plate, and a contact surface of the titanium alloy plate with the steel momentum block both are coated with grease.

4. The method for preparing the gradient hardened titanium alloy as claimed in claim 3, wherein a coating thickness of the grease is in a range of 0.5 mm to 1 mm.

5. The method for preparing the gradient hardened titanium alloy as claimed in claim 1, wherein a material of each of the steel base and the steel momentum block is 45# steel or stainless steel, and a material of the explosive frame is an organic glass.

6. The method for preparing the gradient hardened titanium alloy as claimed in claim 1, wherein the high explosion velocity explosive is castable powder explosive, plastic plate-shaped explosive or rubber plate-shaped explosive.

7. The method for preparing the gradient hardened titanium alloy as claimed in claim 1, wherein the high explosion velocity explosive is composition 4 (C4) explosive.

8. The method for preparing the gradient hardened titanium alloy as claimed in claim 1, wherein the explosive is fixed with the steel base together before the explosive is detonated.

9. The method for preparing the gradient hardened titanium alloy as claimed in claim 1, wherein the impact treatment is performed twice or three times;

wherein a detonation surface of the titanium alloy plate, and a contact surface of the titanium alloy plate with the steel momentum block both are coated with grease, and a coating thickness of the grease is in a range of 0.5 mm to 1 mm;

wherein a material of each of the steel base and the steel momentum block is 45# steel or stainless steel;

wherein a material of the explosive frame is an organic glass;

wherein the high explosion velocity explosive is composition 4 (C4) explosive; and wherein the explosive is fixed with the steel base together before the explosive is detonated.

10. The method for preparing the gradient hardened titanium alloy as claimed in claim 1, wherein the size of the cross section of the through hole is the same as each of the sizes of the cross sections of the steel momentum block and the titanium alloy plate, and the height of the through hole is equal to the total thickness of the steel momentum block and the titanium alloy plate.

11. The method for preparing the gradient hardened titanium alloy as claimed in claim 1, wherein before the placing a steel base on a pre-paved sandpile, the method further comprises:

polishing a surface of a titanium alloy by using a handheld electric grinding wheel to remove an oxide layer and cleaning the surface by using absolute ethyl alcohol to remove grease, to thereby obtain the cleaned titanium alloy plate.

* * * * *